US008788245B2

(12) United States Patent
Taylor

(10) Patent No.: US 8,788,245 B2
(45) Date of Patent: Jul. 22, 2014

(54) SYSTEMS AND METHODS FOR ACTIVELY BIASING A LOADPIN

(75) Inventor: Wesley P. Taylor, Glendale, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 201 days.

(21) Appl. No.: 13/184,074

(22) Filed: Jul. 15, 2011

(65) Prior Publication Data

US 2013/0018638 A1 Jan. 17, 2013

(51) Int. Cl.
*G06F 17/10* (2006.01)

(52) U.S. Cl.
USPC ..... 703/2

(58) Field of Classification Search
USPC ..... 702/174
See application file for complete search history.

(56) References Cited

U.S. PATENT DOCUMENTS

| | | | | |
|---|---|---|---|---|
| 3,631,537 | A * | 12/1971 | Zibolski et al. | 340/522 |
| 4,677,579 | A | 6/1987 | Radomilovich | |
| 4,809,794 | A | 3/1989 | Blair et al. | |
| 5,321,637 | A | 6/1994 | Anderson et al. | |
| 6,025,686 | A | 2/2000 | Wickert et al. | |
| 6,225,574 | B1 | 5/2001 | Chang et al. | |
| 6,401,456 | B1 | 6/2002 | Moriya et al. | |
| 7,082,375 | B2 | 7/2006 | Lueschow | |
| 7,734,397 | B2 | 6/2010 | Peterson et al. | |
| 7,747,396 | B2 * | 6/2010 | El-Bakry et al. | 702/42 |
| 2007/0266601 | A1 | 11/2007 | Claxton | |
| 2009/0228394 | A1 | 9/2009 | Mintah et al. | |
| 2010/0000336 | A1 | 1/2010 | Claxton | |
| 2010/0010714 | A1 | 1/2010 | Claxton | |

FOREIGN PATENT DOCUMENTS

| | | |
|---|---|---|
| WO | 2007121517 | 11/2007 |
| WO | 2009086601 | 7/2009 |

OTHER PUBLICATIONS

Mathworld (Weisstein, Eric W. "Least Squares Fitting." From MathWorld—A Wolfram Web Resource. http://mathworld.wolfram.com/LeastSquaresFitting.html, Feb. 2010, accessed via the internet archive).*

* cited by examiner

*Primary Examiner* — Omar Fernandez Rivas
*Assistant Examiner* — Robert Brock
(74) *Attorney, Agent, or Firm* — Michael Best & Friedrich LLP

(57) ABSTRACT

Systems and methods for actively biasing a loadpin. The systems include, for example, a power shovel positioning module, a loadpin bias module, and an active bias determination module. The power shovel positioning module is configured to determine the position of one or more components of an industrial machine. The loadpin bias module is configured to generate a signal associated with a vector quantity (e.g., having a magnitude and a direction) which can be used to describe the force applied to the loadpin in both an x-direction and a y-direction. The active bias determination module is configured to determine whether the industrial machine is in a proper state or condition to actively bias the loadpin, and determine loadpin bias values during the operation of the industrial machine when the industrial machine is in the proper condition for loadpin biasing.

18 Claims, 12 Drawing Sheets

SYSTEMS AND METHODS FOR ACTIVELY BIASING A LOADPIN

BACKGROUND

The present invention relates to biasing a sensor. Sensors, such as loadpins, are used in industrial machines to calculate the weight of a load being hauled, lifted, or otherwise moved from one location to another. Loadpins are configured to convert an applied force from a mechanical motion into an electrical signal representative of the applied force.

SUMMARY

Although loadpins are effective for relating a mechanical motion to an electrical signal, the accuracy of loadpin measurements limits the capability of a system employing the loadpins to effectively measure a load. For example, loadpins are subject to measurement deviations caused by general wear and tear, temperature fluctuations, etc. These measurement deviations adversely affect the accuracy of the measured load and, as a result, can adversely affect the operation of an industrial machine that relies on the load measurements.

As such, the invention provides systems and methods for actively biasing a loadpin to compensate the electrical signals generated by the loadpin for such measurement deviations caused by, for example, thermal drift, wear and tear, etc. The system includes, among other things, a power shovel positioning module, a loadpin bias module, and an active bias determination module. The power shovel positioning module is configured to determine the position of one or more components of an industrial machine. For example, the power shovel positioning module includes a kinematic model module that determines the position or angle of a dipper based on the output of one or more resolvers and signals associated with the hoist, crowd, and swing values of an industrial machine. The loadpin bias module is configured to generate a signal associated with a vector quantity (e.g., having a magnitude and a direction) which can be used to describe the force applied to the loadpin in both the x-direction and the y-direction. The active bias determination module is configured to, among other things, determine whether the industrial machine is in a proper state or condition to actively bias the loadpin, and determine loadpin bias values during the operation of the industrial machine when the industrial machine is in the proper condition for loadpin biasing.

In one embodiment, the invention provides a method of actively biasing a loadpin associated with an industrial machine. The method includes receiving a first plurality of signals from the loadpin related to a force applied to the loadpin, receiving a second plurality of signals from one or more sensors related to at least one of a hoist parameter, a crowd parameter, and a swing parameter of the industrial machine, generating a first characteristic of the industrial machine based on a first kinematic model of the industrial machine, and generating a second characteristic of the industrial machine based on a second kinematic model of the industrial machine. The first kinematic model being based on the first plurality of signals from the loadpin, and the second kinematic model being based on the second plurality of signals. The method also includes determining an operational condition of the industrial machine, determining whether the loadpin is able to be actively biased based on the operational condition of the industrial machine, and populating one or more angle arrays based on the second kinematic model of the industrial machine and the first kinematic model of the industrial machine when the loadpin is able to be actively biased. A loadpin bias value is then calculated based on the one or more angle arrays.

In another embodiment, the invention provides a system for actively biasing a loadpin associated with an industrial machine. The system includes a memory and a processing device connected to the memory. The memory is configured to store one or more parameters associated with the industrial machine. The processing device is configured to receive a first plurality of signals from the loadpin related to a force applied to the loadpin, receive a second plurality of signals from one or more sensors related to at least one of a hoist parameter, a crowd parameter, and a swing parameter of the industrial machine, generate a first characteristic of the industrial machine based on a first kinematic model of the industrial machine, and generate a second characteristic of the industrial machine based on a second kinematic model of the industrial machine. The first kinematic model being based on the first plurality of signals from the loadpin, and the second kinematic model being based on the second plurality of signals. The processing device is also configured to determine an operational condition of the industrial machine, determine whether the loadpin is able to be actively biased based on the operational condition of the industrial machine, and populate one or more angle arrays based on the second kinematic model of the industrial machine and the first kinematic model of the industrial machine when the loadpin is able to be actively biased. A loadpin bias value is then calculated based on the one or more angle arrays.

In another embodiment, the invention provides a method of actively biasing a loadpin associated with an industrial machine. The method includes generating a first characteristic based on a first kinematic model of the industrial machine, generating a second characteristic based on a second kinematic model of the industrial machine, and determining whether the loadpin is able to be actively biased based on an operational condition of the industrial machine. The first kinematic model being based on a first plurality of signals from the loadpin, and the second kinematic model being based on a second plurality of signals from one or more sensors related to at least one of a hoist parameter, a crowd parameter, and a swing parameter of the industrial machine. The method also includes populating two or more angle arrays based on the second kinematic model of the industrial machine and the first kinematic model of the industrial machine when the loadpin is able to be actively biased, calculating a loadpin bias value based on the two or more angle arrays, and applying the calculated loadpin bias value to the first kinematic model.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Embodiments of the invention described herein relate to the control of an industrial machine (e.g., a power shovel, a crane, etc.) configured to, among other things, raise and lower a load. The industrial machine includes, for example, a dipper, a boom, one or more sheaves, one or more ropes, one or more drive motors, and a control system. In order to determine the weight of a load in the dipper, the control system receives one or more signals from a loadpin. The loadpin is configured to convert a force applied thereto into an electrical signal corresponding to the applied force. However, nonlinearity in the response of the loadpin to applied forces can affect the accuracy of the load determination based on the loadpin signals. To compensate for this nonlinearity, the loadpin is actively biased during the operation of the industrial machine to compensate the loadpin signals for deviations caused by, for example, thermal drift, wear and tear, etc.

Figure 1:
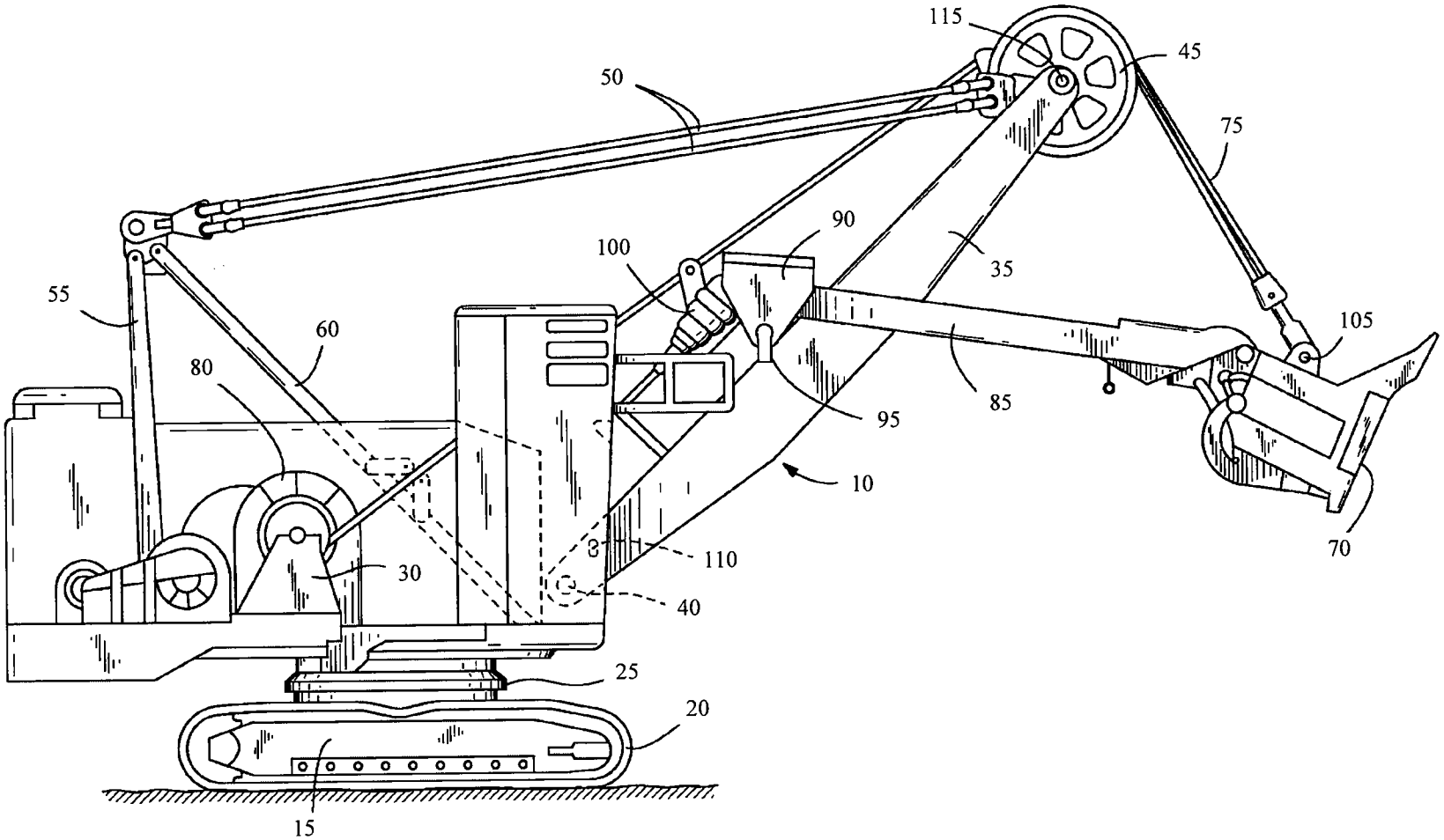
FIG. 1 illustrates an industrial machine according to an embodiment of the invention.

Although this invention can be applied to a variety of industrial machines, embodiments of the invention disclosed herein are described with respect to a power shovel, such as the power shovel 10 shown in FIG. 1. The power shovel 10 is an electric rope shovel or an electric mining shovel. The shovel 10 includes a mobile base 15, drive tracks 20, a turntable 25, a machinery deck 30, a boom 35, a lower end 40, a sheave 45, tension cables 50, a back stay 55, a stay structure 60, a dipper 70, a hoist rope 75, a winch drum 80, dipper arm or handle 85, a saddle block 90, a pivot point 95, a transmission unit 100, a bail pin 105, an inclinometer 110, and a sheave rod 115.

The mobile base 15 is supported by the drive tracks 20. The mobile base 15 supports the turntable 25 and the machinery deck 30. The turntable 25 is capable of 360-degrees of rotation about the machinery deck 30 relative to the mobile base 15. The boom 35 is pivotally connected at the lower end 40 to the machinery deck 30. The boom 35 is held in an upwardly and outwardly extending relation to the deck by the tension cables 50 which are anchored to the back stay 55 of the stay structure 60. The stay structure 60 is rigidly mounted on the machinery deck 30. The sheave 45 is rotatably mounted on the upper end of the boom 35.

The dipper 70 is suspended from the boom 35 by the hoist rope 75. The hoist rope 75 is wrapped over the sheave 45 and attached to the dipper 70 at the bail pin 105. The hoist rope 75 is anchored to the winch drum 80 of the machinery deck 30. As the winch drum 80 rotates, the hoist rope 75 is paid out to lower the dipper 70 or pulled in to raise the dipper 70. The dipper 70 also includes the dipper handle 85 rigidly attached thereto. The dipper arm 85 is slideably supported in a saddle block 90, and the saddle block 90 is pivotally mounted to the boom 35 at the pivot point 95. The dipper handle 85 includes a rack tooth formation thereon which engages a drive pinion mounted in the saddle block 90. The drive pinion is driven by an electric motor and transmission unit 100 to extend or retract the dipper arm 85 relative to the saddle block 90.

An electrical power source is mounted to the machinery deck 30 to provide power to one or more hoist electric motors for drive the winch drum 80, one or more crowd electric motors to drive the saddle block transmission unit 100, and one or more swing electric motors to turn the turntable 25. Each of the crowd, hoist, and swing motors are driven by its own motor controller or drive in response to control voltages and currents corresponding to operator commands.

Figure 2:
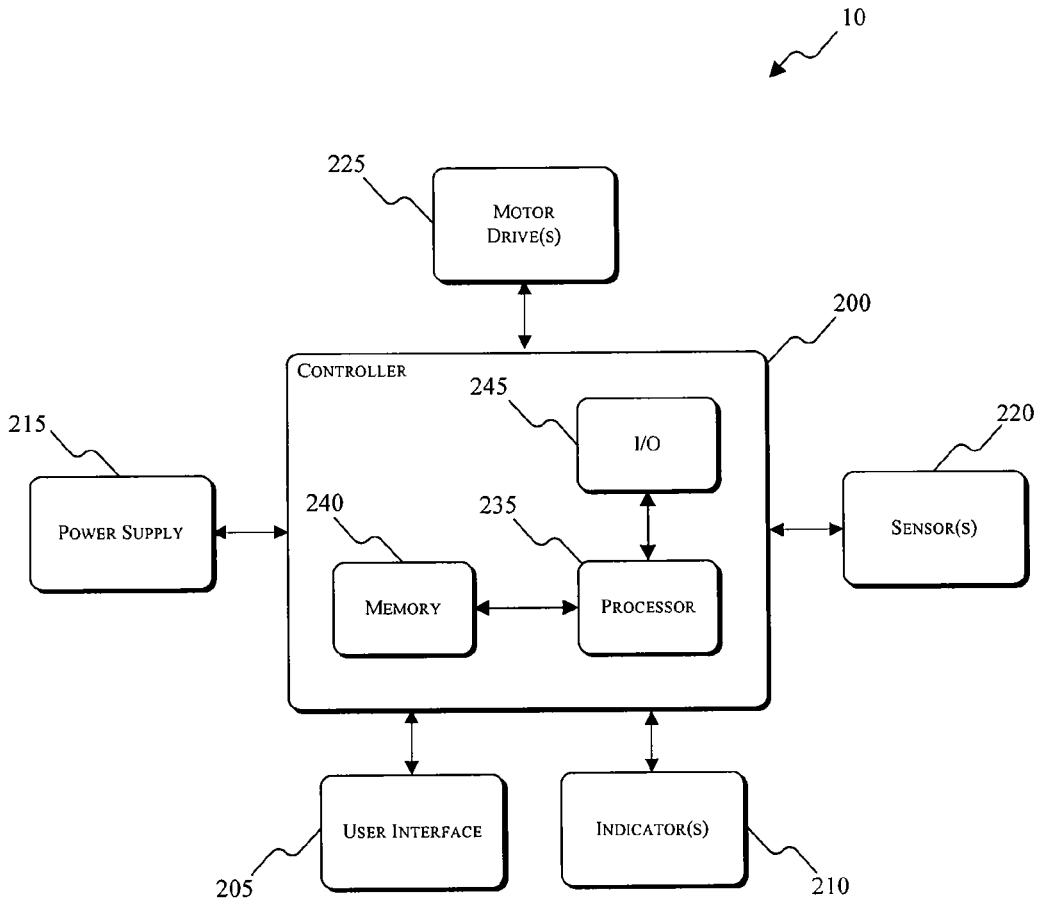
FIG. 2 illustrates a controller according to an embodiment of the invention.

FIG. 2 illustrates a controller 200 and system associated with the power shovel 10 of FIG. 1. The controller 200 is connected or coupled to a variety of additional modules or components, such as a user interface module 205, one or more indicators 210, a power supply module 215, one or more sensors 220, and one or more motors or drive mechanisms 225. The one or more motors or drive mechanisms include, for example, the one or more hoist, crowd, and swing motors introduced above with respect to FIG. 1. The one or more sensors 220 include, among other things, a loadpin strain gauge. The loadpin strain gauge includes, for example, a bank of strain gauges positioned in an x-direction (e.g., horizontally) and a bank of strain gauges positioned in a y-direction (e.g., vertically) such that a resultant force on the loadpin can be determined. The controller 200 includes combinations of software and hardware that are operable to, among other things, control the operation of the power shovel 10, control the position of the boom 35, the dipper arm 85, the dipper 70, etc., activate the one or more indicators 210 (e.g., LEDs or a liquid crystal display ["LCD"]), etc. The controller 200 includes, among other things, a processing unit 235 (e.g., a microprocessor, a microcontroller, or another suitable programmable device), a memory 240, and an input/output ("I/O") system 245. The processing unit 235, the memory 240, the I/O system 245, as well as the various modules connected to the controller 200 are connected by one or more control and/or data buses. The control and/or data buses are omitted from FIG. 2 for descriptive and clarity purposes. The use of one or more control and/or data buses for interconnecting the various modules and components would be known to a person skilled in the art in view of the invention described herein.

The memory 240 includes, for example, a read-only memory ("ROM"), a random access memory ("RAM"), an electrically erasable programmable read-only memory ("EEPROM"), a flash memory, a hard disk, an SD card, or another suitable magnetic, optical, physical, or electronic memory device. The processing unit 235 is connected to the memory 240 and executes software that is capable of being stored in a RAM (e.g., during execution), a ROM (e.g., on a generally permanent basis), or another non-transitory computer readable medium such as another memory or a disc. Additionally or alternatively, the memory 240 is included in the processing unit 235. The I/O system 245 includes routines for transferring information between components within the controller 200 and other components of the power shovel 10 using the one or more buses described above. Software included in the implementation of the power shovel 10 can be stored in the memory 240 of the controller 200. The software includes, for example, firmware, one or more applications, program data, one or more program modules, and other executable instructions. The controller 200 is configured to retrieve from memory and execute, among other things, instructions related to the control processes and methods described herein. In other constructions, the controller 200 includes additional, fewer, or different components. The power supply module 215 supplies a nominal AC or DC voltage to the power shovel 10.

The user interface module 205 is used to control or monitor the power shovel 10. For example, the user interface module 205 is operably coupled to the controller 200 to control the position of the dipper 70, the transmission unit 100, the position of the boom 35, the position of the dipper handle 85, etc. The user interface module 205 can include a combination of digital and analog input or output devices required to achieve a desired level of control and monitoring for the power shovel 10. For example, the user interface module 205 can include a display and input devices such as a touch-screen display, one or more knobs, dials, switches, buttons, etc. The display is, for example, a liquid crystal display ("LCD"), a light-emitting diode ("LED") display, an organic LED ("OLED") display, an electroluminescent display ("ELD"), a surface-conduction electron-emitter display ("SED"), a field emission display ("FED"), a thin-film transistor ("TFT") LCD, etc. In other constructions, the display is a Super active-matrix OLED ("AMOLED") display. The user interface module 205 can also be configured to display conditions or data associated with the power shovel 10 in real-time or substantially real-time. For example, the user interface module 205 is configured to display measured electrical characteristics of the power shovel 10, the status of the power shovel 10, the position of the dipper 70, the position of the dipper handle 85, etc. In some implementations, the user interface module 205 is controlled in conjunction with the one or more indicators 210 (e.g., LEDs) to provide visual indications of the status or conditions of the power shovel 10.

Figure 3:
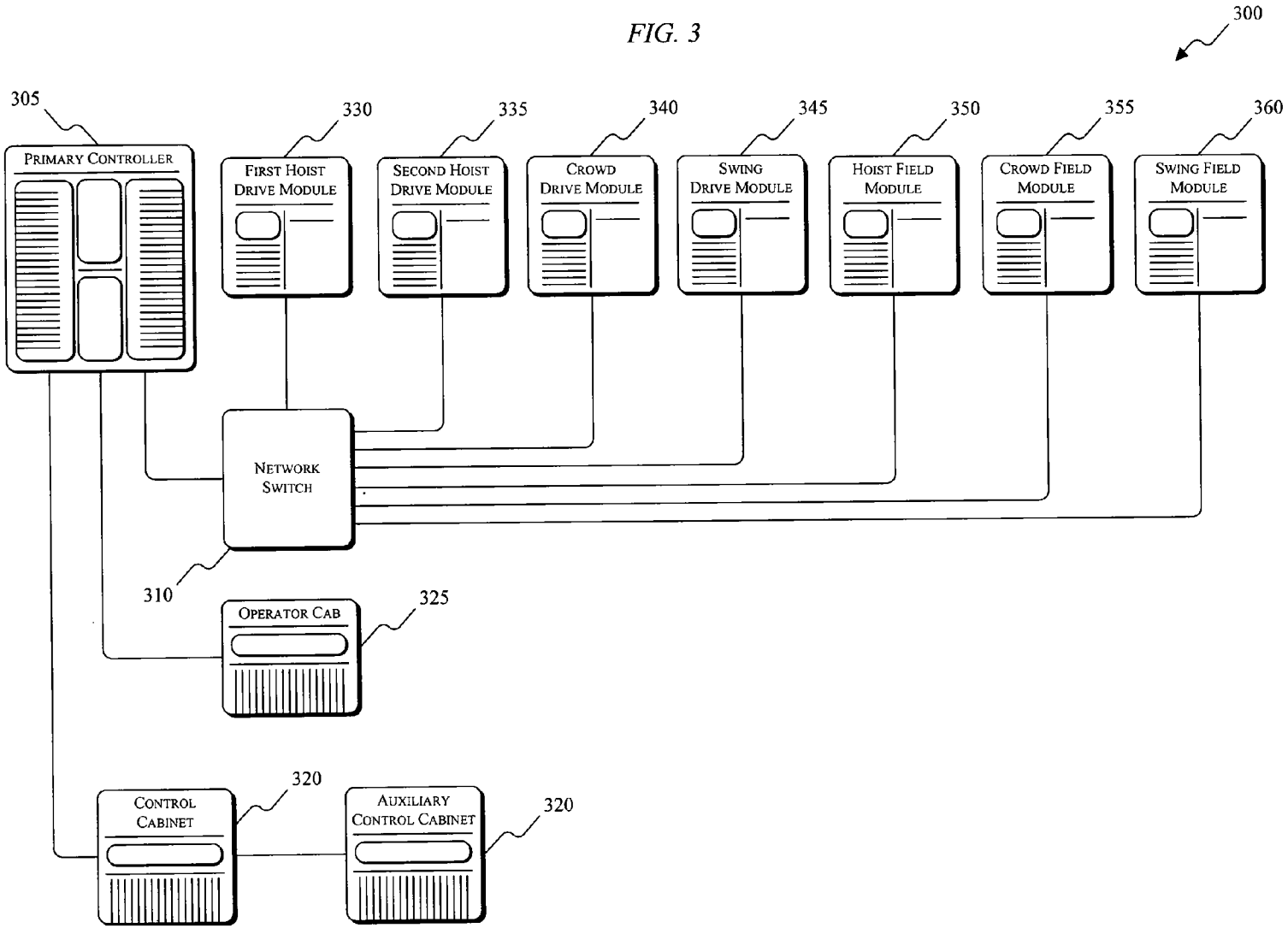
FIG. 3 illustrates control system for an industrial machine according to an embodiment of the invention.

FIG. 3 illustrates a more detailed control system 300 for the power shovel 10. For example, the power shovel 10 includes a primary controller 305, a network switch 310, a control cabinet 315, an auxiliary control cabinet 320, an operator cab 325, a first hoist drive module 330, a second hoist drive module 335, a crowd drive module 340, a swing drive module 345, a hoist field module 350, a crowd field module 355, and a swing field module 360. The various components of the control system 300 are connected by and communicate through one or more network protocols for industrial automation, such as process field bus ("PROFIBUS"), Ethernet, ControlNet, Foundation Fieldbus, INTERBUS, controller-area network ("CAN") bus, etc. The control system 300 can include the components and modules described above with respect to FIG. 2. For example, the motor drives 225 can correspond to the hoist, crowd, and swing drives 330, 335, and 340, the user interface 205 and the indicators 210 can be included in the operator cab 325, etc. The loadpin strain gauge can provide electrical signals indicative of forces applied to the loadpin to the primary controller 305, the controller cabinet 315, the auxiliary cabinet 320, etc.

Figure 4:
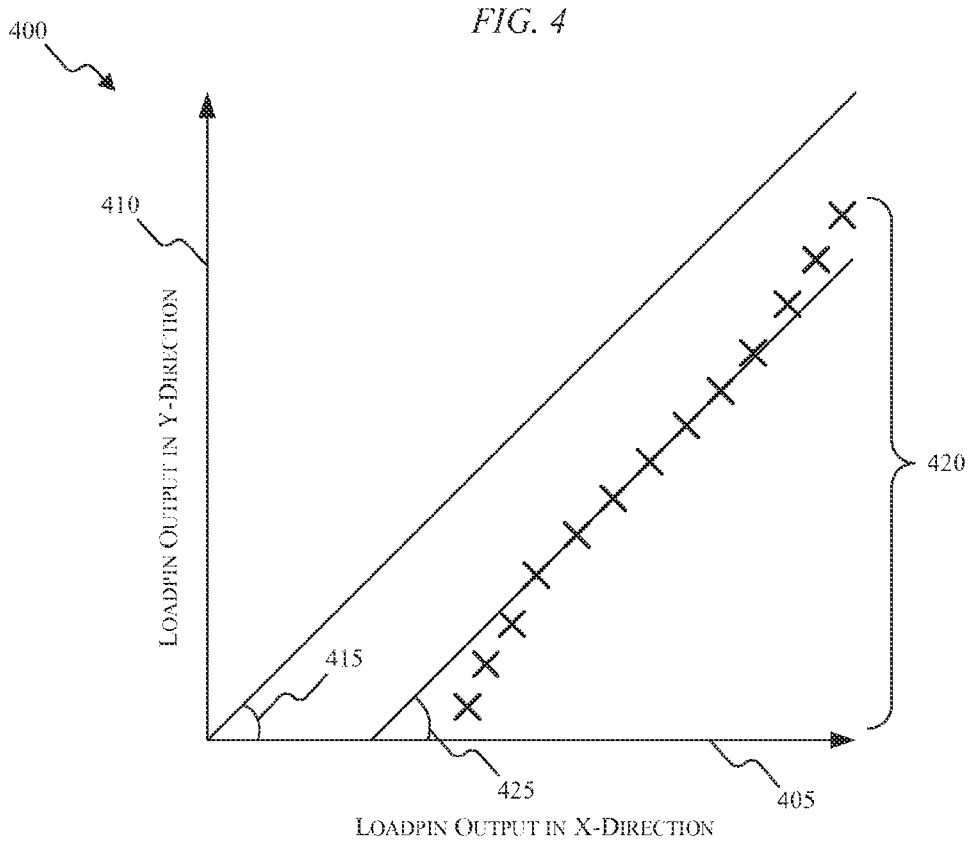
FIGS. 4 and 5 illustrate deviation in a loadpin sensor.
Figure 5:
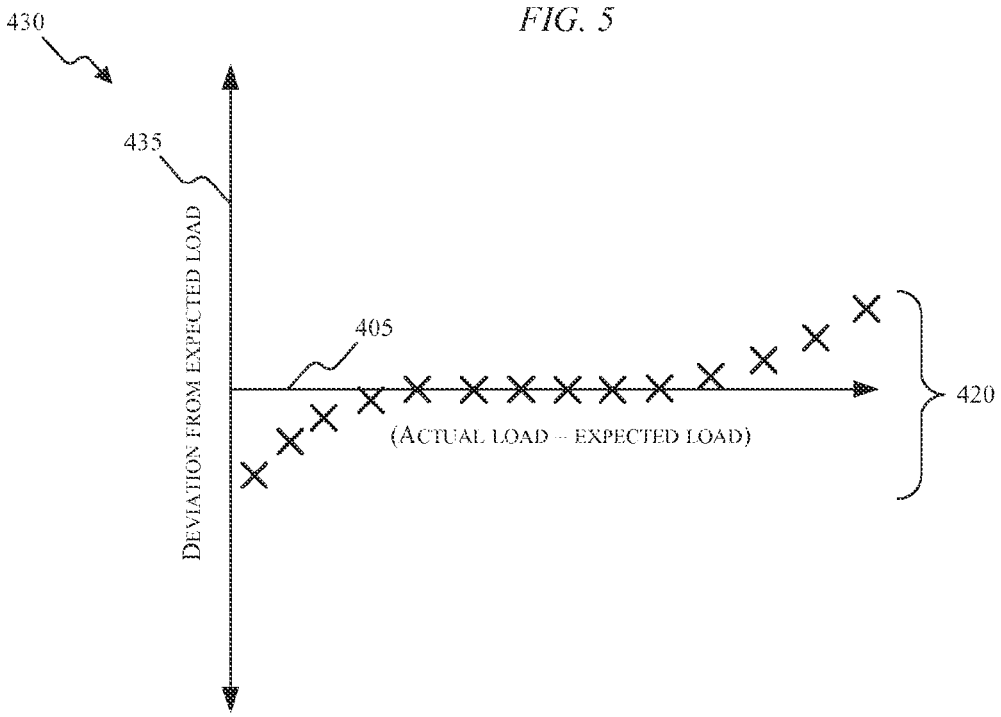

Although the loadpin strain gauge described above is configured to achieve a linear relationship with respect to an applied force, the relationship between the output of the strain gauge and the force applied to the strain gauge is often not perfectly linear. For example, the strain gauge may include a deviation of approximately ±2%. FIGS. 4 and 5 illustrate the non-linearity of the output of such a strain gauge. A plot 400 in FIG. 4 includes an x-axis 405 and a y-axis 410. In the illustrated example, the power shovel 10 kinematic model indicates that the output from the loadpin should correspond to an angle 415 of 45° (e.g., a cable wrap angle around sheave 45). However, when the output signal measurements 420 from the loadpin are plotted against the expected angular output, the output signal measurements 420 illustrate deviations at the high and low ends of the measurement range. By superimposing a line forming a 45° angle 425 with the x-axis, the non-linearity of the measurements 420 can be seen. The plot 400 of the measurements 420 in FIG. 4 is indicative of the quality of the measurements from the loadpin. FIG. 5 is a plot 430 of the deviation along a deviation axis 435 of the measurements 420 with respect to the x-axis 405. FIG. 5 illustrates the linearity of the loadpin measurements for intermediate loads and the increase in deviation at the extremes of the loadpin measurement range.

Figure 6:
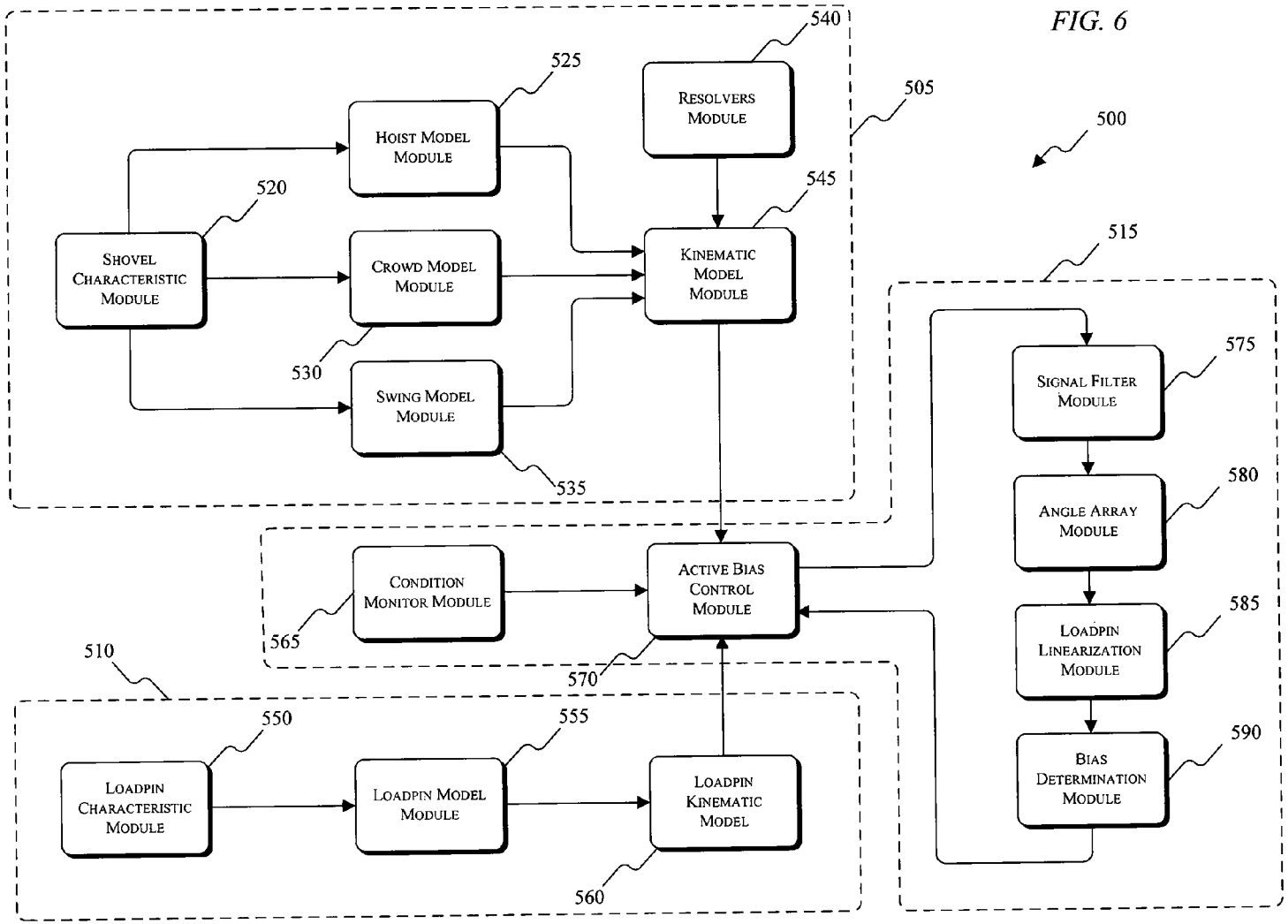
FIG. 6 illustrates a system for actively biasing a loadpin according to an embodiment of the invention.

FIG. 6 illustrates a system 500 for actively biasing a loadpin to compensate for the deviation in loadpin measurements described above with respect to FIGS. 4 and 5. The system 500 can be implemented by, for example, the controller 200 described above. The system includes a power shovel positioning module 505, a loadpin bias module 510, and an active bias determination module 515. The power shovel positioning module 505 is configured to determine the position of one or more components of the power shovel 10 (e.g., the dipper 70, the boom 35, the dipper handle 85, etc.). The power shovel positioning module 505 includes a shovel characteristic module 520, a hoist model module 525, a crowd model module 530, a swing model module 535, a resolvers module 540, and a kinematic model module. The shovel characteristic module 520 includes known physical parameters, geometries, operational parameters, etc., associated with the power shovel 10. This information can be specific to a particular shovel or generalized to be associated with a variety of shovels. The information within the shovel characteristic module 520 is used by the hoist model module 525, the crowd model module 530, and the swing model module 535 to provide one or more hoist, crowd, and swing parameters to the kinematic model module 545. The kinematic model module 545 also receives signals and information from the resolvers module 540 related to the positions or characteristics of shovel components. The resolvers module 540 is electrically, communicatively, and/or physically connected to one or more resolvers. The resolvers are, for example, rotary displacement resolvers mounted to various gears within the power shovel. The resolvers provide electrical signals to the resolvers module 540. The resolvers module 540 is configured to pass-through, condition, process, etc., the electrical signals from the one or more resolvers. In some embodiments, the resolvers module 540 filters the electrical signals from the one or more resolvers before the signals are provided to the kinematic model module 545. The kinematic model module 545 is used to determine or calculate, for example, a shovel 10 characteristic such as the position of the dipper, hoist wrap angle about the sheave 45, etc., based on the output of the resolvers module 540 and hoist, crowd, and swing signals from the hoist model module 525, the crowd model module 530, and the swing model module 535, respectively. In some embodiments, the power shovel positioning module 505 is configured to operate in a manner similar to the load weighing system described in U.S. Pat. No. 6,225,574, entitled "LOAD WEIGHING SYSTEM FOR A HEAVY MACHINERY," issued May 2, 2001, the entire content of which is hereby incorporated by reference.

The loadpin bias module 510 includes a loadpin characteristic module 550, a loadpin model module 555, and a loadpin kinematic model module 560. The loadpin characteristic model 550 includes, for example, calibration data associated with the loadpin. The calibration data can include calibration parameters specific to the loadpin installed on the power shovel 10 (e.g., calibration parameters determined prior to installing the loadpin) as well as updated calibration parameters determined during the operation of the power shovel 10. In some embodiments, the power shovel 10 is configured to recalibrate parameters in a real-time manner throughout the operation of the power shovel. In other embodiments, a calibration procedure is executed during downtime for the power shovel 10. The calibration parameters include, among other things, the values necessary to convert a force applied to the loadpin into an electrical signal (e.g., a voltage) corresponding to the applied force. The loadpin model module 555 receives the calibration parameters for the loadpin from the loadpin characteristic module and generates an electrical signal associated with a force applied to the loadpin. For example, the loadpin model module 555 includes the functions, relationships, etc., necessary to convert or associate the electrical signal related to the force applied to the loadpin into a calibrated electrical signal corresponding to the magnitude and direction of the applied force. In some embodiments, the loadpin model module 555 generates a signal associated with a vector quantity (e.g., having a magnitude and a direction) which can be used to describe the force applied to the loadpin in both the x-direction and the y-direction. In other embodiments, the loadpin model module 555 is configured to generate multiple signals corresponding to forces applied to the loadpin in different directions (e.g., the x-direction and the y-direction).

The loadpin kinematic model 560 includes information associated with the geometry of the power shovel 10 and dipper 70. The loadpin kinematic model module 560 receives the signal or signals from the loadpin model module 555 and uses a loadpin kinematic model to determine or calculate, for example, a shovel characteristic such as dipper position, hoist wrap angle about the sheave 45, loadpin force in the x-direction, loadpin force in the y-direction, etc.

The active bias determination module 515 includes a condition monitor module 565, an active bias module 570, a signal filter module 575, an angle array module 580, a loadpin linearization module 585, and a bias determination module 590. The condition monitor module 565 is configured to monitor the operational state of the power shovel 10 to determine whether the power shovel 10 is in a proper state or condition to actively bias the loadpin. The condition monitor module 565 is described in greater detail below. The active bias control module 570 receives signals from the power shovel positioning module 505, the loadpin bias module 510, and the condition monitor 565. The active bias control module 570 is configured to control or supervise the determination and implementation of loadpin bias values. In the illustrated embodiment the active bias control module 570 is shown separately from the signal filter module 575, the angle array module 580, the loadpin linearization module 585, and the bias determination module 590. However, in other embodiments, the modules 575, 580, 585, and 590 can be combined into a single module, or the modules 575, 580, 585, and 590 can be included as sub modules within the active bias control module 570.

The signal filter module 575 is configured to smooth the loadpin signals that are used in the determination of loadpin bias. For example, the signal filter module 575 filters out fluctuations in the loadpin signals that result from rope slap and other dynamic responses. Filtering the loadpin signals stabilizes the signals in order to produce more reliable bias values. In some embodiments, the signal filter module 575 is omitted from the active bias determination module 515 or is included but not used to smooth the loadpin signals. The angle array module 580 is configured to generate one or more angle arrays. Each angle array includes a plurality of data samples related to forces sensed by the loadpin strain gauge. In some embodiments, the angle arrays are matrices, tables, etc. For example, when kinematic model module 545 or the forces applied to the loadpin indicate that the dipper 70 is in a position corresponding to a particular angle (e.g., +/− approximately 0.1°), the forces on the loadpin are saved to the angle array corresponding to the particular angle. In some embodiments, the angle arrays are populated in one degree intervals (e.g., 45°, 46°, 47°, etc.). In other embodiments, the angle arrays are populated in larger intervals (e.g., 2° intervals) or smaller intervals (e.g., less than 1°). The number of angle arrays that are populated through the full range of motion of the dipper 70 depends on, for example, the accuracy with which the angles can be determined and the desired accuracy of payload estimation. In some embodiments, approximately five or more angle arrays are used to determine the loadpin bias, and each angle array is populated with approximately twenty-five data points (e.g., x and y component force values from the loadpin).

In some embodiments, the characteristic angle determined using the loadpin kinematic model is compared or associated with the characteristic angle determined using the kinematic model module 545. In such embodiments, the angle arrays are populated based on both an output of the kinematic model module 545 and the loadpin kinematic model 560. The comparison of the characteristic angles generated using each of the kinematic models is illustrative of, for example, the linearity of the loadpin, accuracy of the kinematic models, etc. The angle arrays are described in greater detail below with respect to FIGS. 7-10.

The loadpin linearization module 585 is configured to linearize the data stored in each angle array. As indicated above, the loadpin system is not perfectly linear. The signals generated in response to a load on the loadpins include an error (e.g., approximately 2%). This deviation can adversely affect calculated bias values. To remove or minimize the effects of this deviation on the calculated loadpin bias values, each of the angle arrays is linearized using a least squares linear regression technique. The regression technique can be implemented using, for example, EQNS. 1-3 below.

$$y = a_1 x + a_0 \qquad \text{EQN. 1}$$

$$a_1 = \frac{n\sum x_i y_i - \sum x_i \sum y_i}{n\sum x_i^2 - (\sum x_i)^2} \qquad \text{EQN. 2}$$

$$a_0 = \bar{y} - a_1 \bar{x} \qquad \text{EQN. 3}$$

where $a_1$ is a line slop, $a_0$ is a y-intercept, n is a number of force samples, $x_i$ is a force component in an x-direction for a particular applied force, and $y_i$ is a force component in a y-direction for a particular applied force. EQN. 2 can be used with each of the force samples, n, to determine the slope of an angle array line.

By linearizing the angle arrays, the affects that outlier data samples, noise, and other dynamic responses from the loadpin have on the calculated bias values are reduced or eliminated. Following the linearization of the angle arrays, the slope, $a_1$, of the line provided above in EQN. 1, should be equal to or approximately equal to the slope of the angle associated with the corresponding data set. If the slope, $a_1$, is not equal to or is not substantially equal to the slope of the angle identified to coordinate the corresponding data set (e.g., not within approximately +/−5%), the slope, $a_1$, of the angle is not used in the calculation of the loadpin bias. Alternatively, a hoist wrap angle determined using the kinematic model module 545 can be used as the slope of the data set line. By forcing the slope of the linearization to match the force angle yields the best approximation for the loadpin's response at that particular force angle. This reduces the effects of dynamic forces and signal noise on the loadpin bias calculations. A least squares linear regression can then be used to calculate the loadpin offset, as described below.

Figure 7:
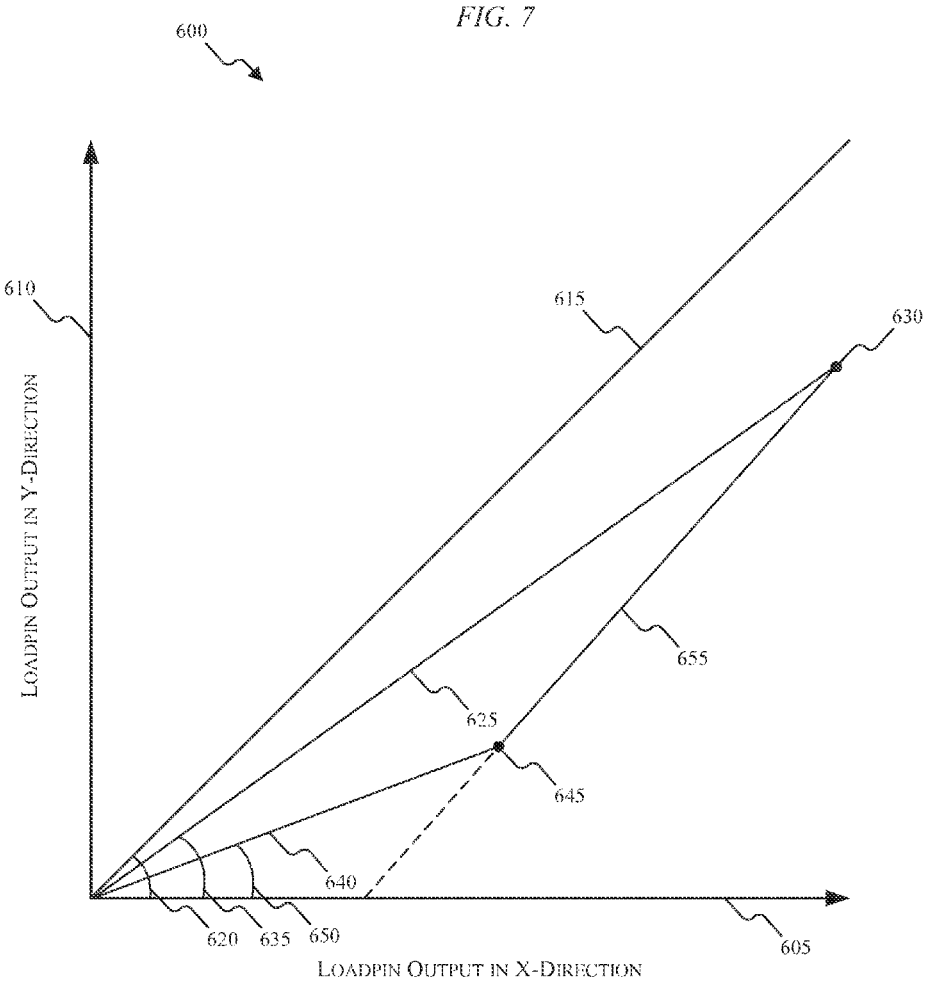
FIG. 7 illustrates a first set of angle array data according to an embodiment of the invention.

The bias determination module 590 is configured to use the linearized angle arrays to determine a loadpin bias in the x-direction and a loadpin bias in the y-direction. The determination of the loadpin bias in both the x- and y-directions is graphically illustrated in FIGS. 7-10. The linearized angle arrays are used to find an intersection point between the lines formed from the linearized data sets. For example, FIG. 7 illustrates a plot 600 of loadpin output values with respect to an x-axis 605 and a y-axis 610. The plot 600 includes a first line 615 corresponding to a shovel kinematic model angle 620. As described above, the kinematic model angle 620 is determined based on shovel parameters such as hoist wrap, etc. A second line 625 is associated with a point 630 at which the loadpin detects a full or maximum load (e.g., the dipper 70 is full) for a first loadpin kinematic model angle 635. A third line 640 is associated with a point 645 at which the loadpin detects an empty or minimum load for a second loadpin kinematic model angle 650. Like the first line 615, the second line 625 and the third line 640 have respective angles 635 and 650 with respect to the x-axis 605. A fourth line 655 formed between the point 630 of the second line 625 and point 645 of the third line 640 corresponds to a linearized output for the loadpin at the shovel kinematic model angle 620.

Figure 8:
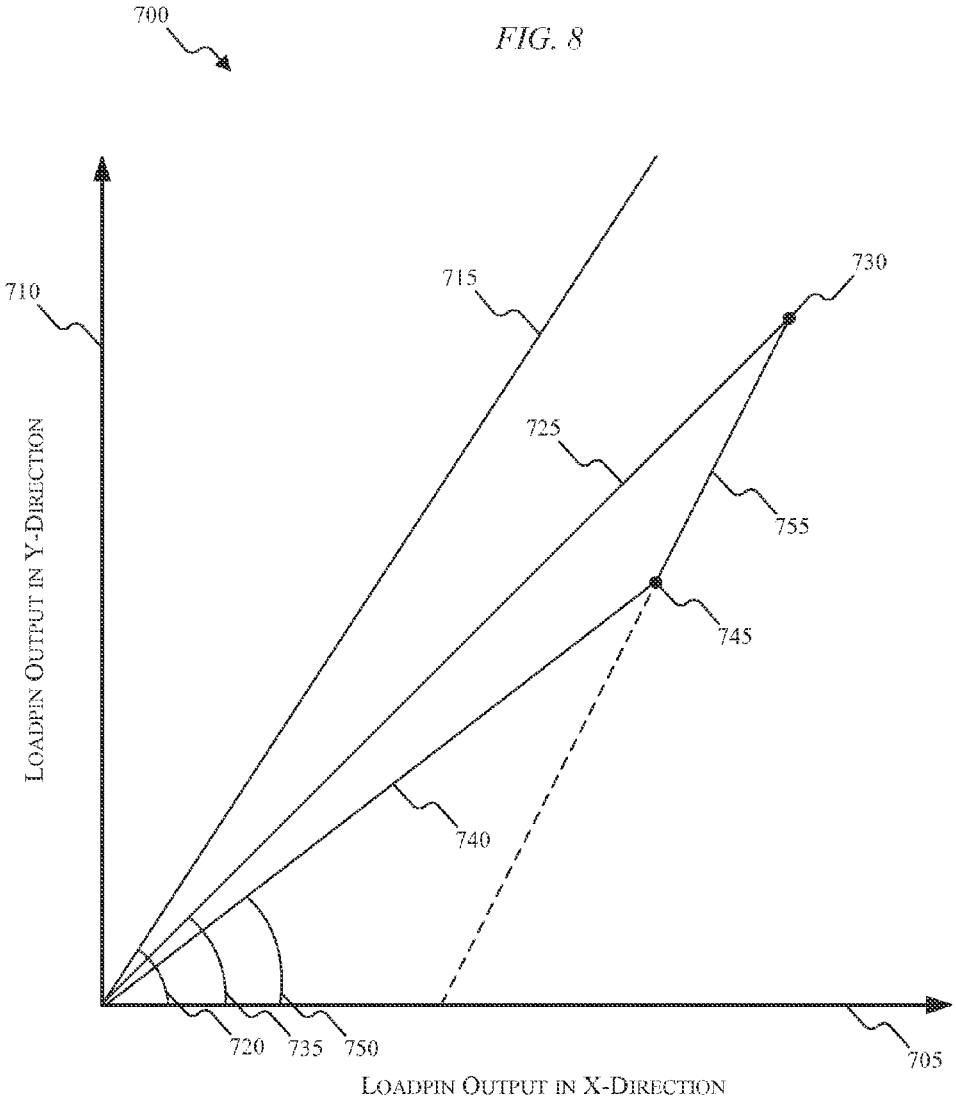
FIG. 8 illustrates a second set of angle array data according to an embodiment of the invention.

Similarly, FIG. 8 illustrates a plot 700 of loadpin output values with respect to an x-axis 705 and a y-axis 710. The plot includes a first line 715 corresponding to a shovel kinematic model angle 720. As described above, the kinematic model angle 720 is determined based on shovel parameters such as hoist wrap, etc. A second line 725 is associated with a point 730 at which the loadpin detects a full or maximum load (e.g., the dipper 70 is full) for a first loadpin kinematic model angle 735. A third line 740 is associated with a point 745 at which the loadpin detects an empty or minimum load for a second loadpin kinematic model angle 750. Like the first line 715, the second line 725 and the third line 740 have respective angles 735 and 750 with respect to the x-axis 705. A fourth line 755 formed between the point 730 of the second line 725 and point 745 of the third line 740 corresponds to a linearized output for the loadpin at the shovel kinematic model angle 720.

Figure 9:
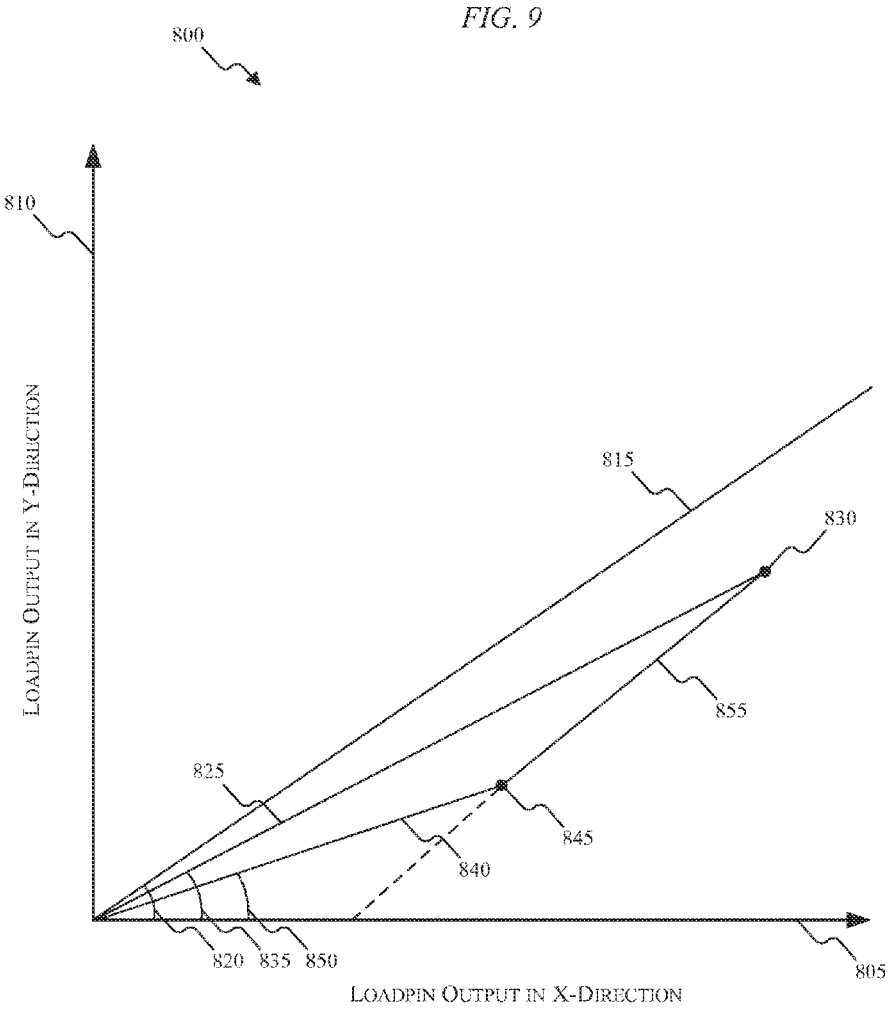
FIG. 9 illustrates a third set of angle array data according to an embodiment of the invention.

FIG. 9 illustrates a plot 800 of loadpin output values with respect to an x-axis 805 and a y-axis 810. The plot includes a first line 815 corresponding to a shovel kinematic model angle 820. As described above, the kinematic model angle 820 is determined based on shovel parameters such as hoist wrap, etc. A second line 825 is associated with a point 830 at which the loadpin detects a full or maximum load (e.g., the dipper 70 is full) for a first loadpin kinematic model angle 835. A third line 840 is associated with a point 845 at which the loadpin detects an empty or minimum load for a second loadpin kinematic model angle 850. Like the first line 815, the second line 825 and the third line 840 have respective angles 835 and 850 with respect to the x-axis 805 and y-axis 810. A fourth line 855 formed between the point 830 of the second line 825 and point 845 of the third line 840 corresponds to a linearized output for the loadpin at the shovel kinematic model angle 820.

Figure 10:
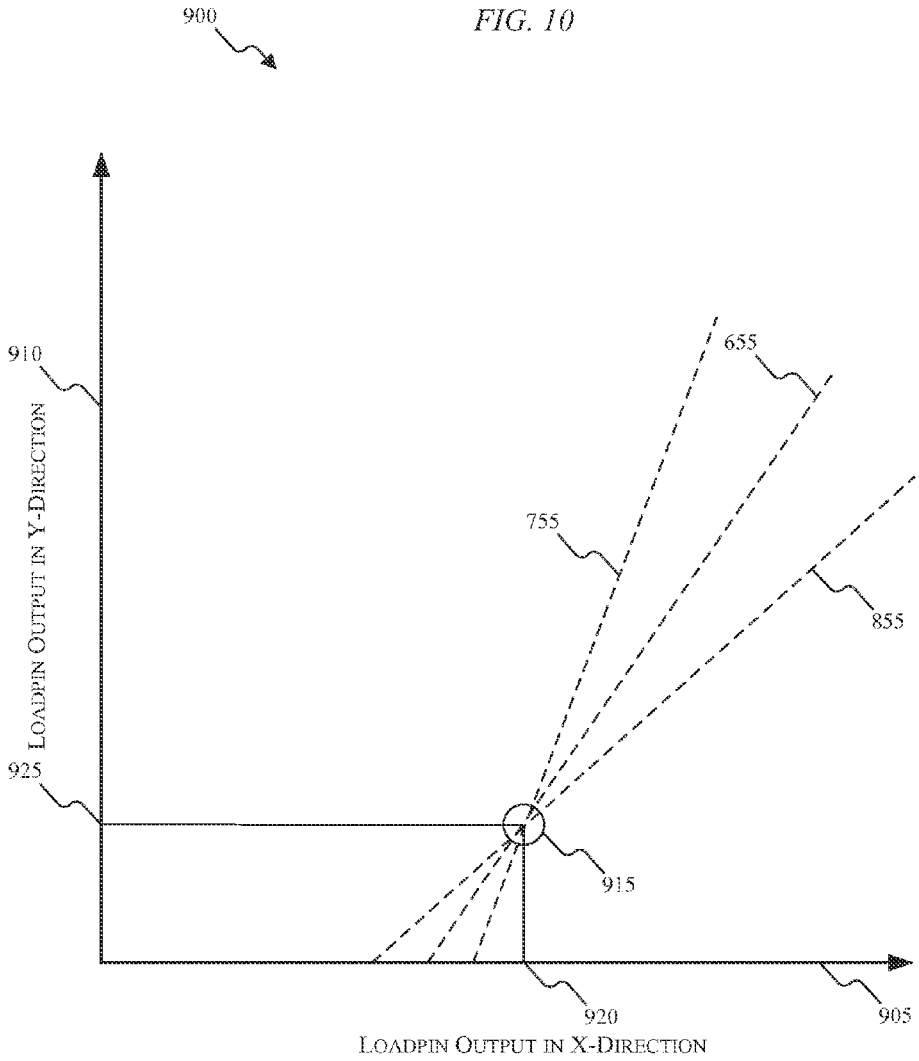
FIG. 10 illustrates a loadpin bias according to an embodiment of the invention.

Using the fourth line 655 from FIG. 7, the fourth line 755 from FIG. 8, and the fourth line 855 from FIG. 9, a loadpin offset in the x-direction and a loadpin offset in the y-direction can be conceptually determined as shown in the plot 900 of FIG. 10 having an x-axis 905 and a y-axis 910. The lines 655, 755, and 855 intersect one another at an intersection point 915. The intersection point 915 for the linearized outputs of the loadpin corresponds to the loadpin offset in the x-direction 920 and the loadpin offset in the y-direction 925.

Alternatively, the controller 200 or active bias determination module 515 determines the loadpin bias values in the x- and y-directions by executing a software program stored in memory that is configured to identify the graphical x- and y-intercepts shown in FIG. 10. For example, the determination or calculation of the loadpin bias values in both the x-direction and the y-direction is accomplished using a least squares calculation, such as that provided below in EQNS. 4-7.

$$y_{bias} = 0 \qquad \text{EQN. 4}$$

$$x_{bias} = 0 \qquad \text{EQN. 5}$$

$$y_{bias} = y_{bias} + \left[\frac{\sum m^2}{n\sum m^2 - (\sum m)^2} - m_i \frac{\sum m}{n\sum m^2 - (\sum m)^2}\right] b_i \qquad \text{EQN. 6}$$

$$x_{bias} = x_{bias} + \left[\frac{\sum m}{n\sum m^2 - (\sum m)^2} - n \frac{m_i}{n\sum m^2 - (\sum m)^2}\right] b_i \qquad \text{EQN. 7}$$

where $m_i$ is the slope a line formed by a single angle array, $b_i$ is a y-intercept for the line formed by the angle array, n is the number of lines (i.e., the number of angle arrays used to determine the loadpin bias), and $\Sigma m$ is a summation of the slopes of each of the lines formed by the angle arrays.

The loadpin signals used to determine the bias values need to be captured during stable motions. For example, the power shovel 10 digging into a bank is a highly dynamic movement and can corrupt the data that is used to populate the angle arrays. The condition monitor module 565 (see FIG. 6) is used to monitor the state of the power shovel 10. When the condition monitor determines that the power shovel 10 is a state that is conducive to populating the angle arrays with reliable data, the power shovel 10 performs active loadpin biasing. If the condition monitor 565 determines that the power shovel 10 is not in a state that is conducive to populating the angle arrays with reliable data (e.g., digging, swinging, etc.), the power shovel is prevented from actively biasing the loadpin.

Following the determination of the loadpin bias values (e.g., the loadpin bias in the x-direction and the loadpin bias in the y-direction), the controller 200 determines whether the power shovel 10 is in a state that is conducive to implementing the new loadpin bias values. For example, if the power shovel is in a swing state, a transient dynamic period following a swinging operation, performing a load weight calculation, etc., the controller 200 delays the implementation of the calculated loadpin bias values.

The controller 200 is also configured to regularly recalculate the loadpin bias from new data in the angle arrays to determine whether the loadpin bias is correct or needs to be recalculated. In some embodiments, the controller 200 is also configured to monitor the linearity of the angle array data sets. For example, as a loadpin is repeatedly exposed to stresses, the resulting strain can cause fatigue which can affect the accuracy of the loadpin (e.g., the linearity of the loadpin, sensitivity to force, etc.). The controller 200 can calculate the linearity or an error of the angle array data sets and compare the linearity to one or more predetermined threshold values. If, for example, the non-linearity of the angle array data sets exceeds the one or more predetermined threshold values, the controller 200 determines that the loadpin has become unreliable and should be replaced or fixed.

Figure 11:
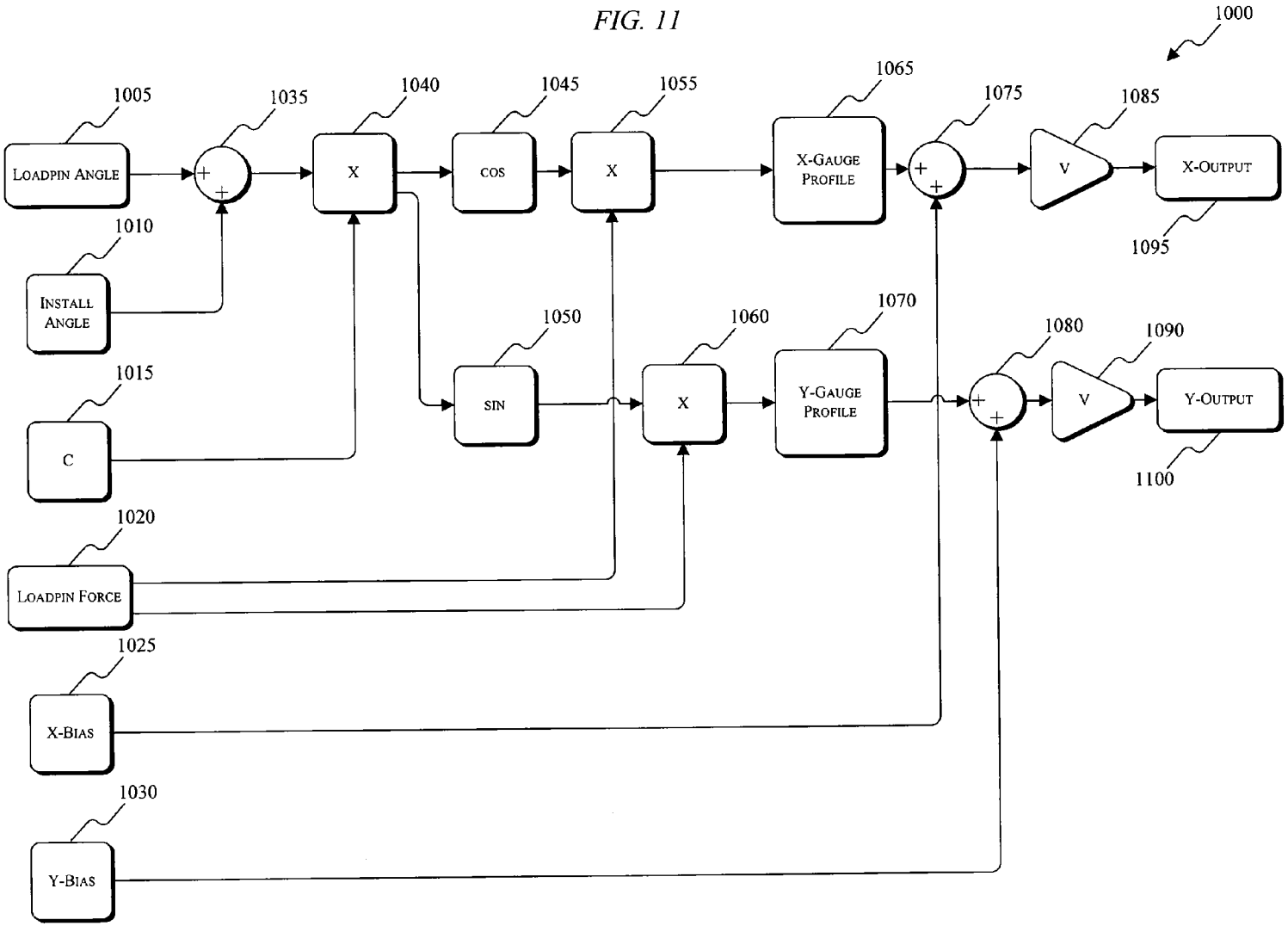
FIG. 11 illustrates a system for implementing a loadpin bias according to an embodiment of the invention.

FIG. 11 illustrates an embodiment of a loadpin biasing system 1000 for implementing the determined loadpin offsets. For example, the loadpin biasing system 1000 is configured to apply a loadpin offset to the loadpin kinematic model module 560 described above or a payload estimation system. The system 1000 is configured to operate continuously during the operation of a shovel control system such as the Centurion Digital Drive and Control System or load determination systems such as the Payload System, both produced and sold by P&H Mining Equipment, Milwaukee, Wis. The system 1000 includes a loadpin angle input 1005, an install angle input 1010, and a conversion constant input 1015. The system 1000 also includes a loadpin force input 1020, a loadpin bias in the x-direction input 1025, and a loadpin bias in the y-direction input 1030. As previously described, the loadpin angle input 1005 is determined using loadpin force vectors in the x-direction and/or the y-direction, or using the shovel kinematic model module 545. The loadpin angle input 1005 is combined (e.g., summed, differenced, etc.) with the loadpin install angle input 1010 at a first summation module 1035. The output of the first summation module 1035 and the conversion constant input 1015 are provided to a multiplication module 1040 where the output of the first summation module 1035 (e.g., in degrees) is converted to radians. For example, the output of the first summation module 1035 is multiplied by the conversion constant input 1015 to generate an output of the first multiplication module 1040 corresponding to a loadpin angle in radians.

The output of the first multiplication module 1040 is provided to a first trigonometric module 1045 and a second trigonometric module 1050. For example, the first trigonometric module 1045 is configured to calculate a cosine of the loadpin angle in radians, and the second trigonometric module 1050 is configured to calculate a sine of the loadpin angle in radians. The output of the first trigonometric module 1045 and the loadpin force input 1020 are provided to a second multiplication module 1055 that multiples the cosine of the loadpin angle and the loadpin force input to generate a loadpin force in the x-direction. Similarly, the output of the second trigonometric module 1050 and the loadpin force input 1020 are provided to a third multiplication module 1060 that multiples the sine of the loadpin angle and the loadpin force input 1020 to generate a loadpin force in the y-direction. The loadpin force in the x-direction and the loadpin force in the y-direction are then provided to a loadpin strain gauge profile module for the x-direction 1065 and the loadpin strain gauge profile module for the y-direction 1070, respectively. The profile modules 1065 and 1070 include information associated with the characteristics of the loadpin strain gauges positioned for the detection of forces in the x-direction and the y-direction. For example, the characteristics of the strain gauges can be determined at the time of manufacture or assembly and programmed into the controller 200. Additionally or alternatively, the characteristics of the strain gauges in both the x-direction and y-direction can be recalibrated on a regular or continual basis to ensure that the gauge profiles accurately represent the response of the loadpin to an applied force in either direction. The output of the loadpin strain gauge profile module for the x-direction 1065 is provided to a second summation module 1075 where the output is combined with the loadpin bias in the x-direction input 1025. The output of the loadpin strain gauge profile module for the y-direction 1070 is provided to a third summation module 1080 where the output is combined with the loadpin bias in the y-direction input 1030. The outputs of the second summation module 1075 and the third summation module 1080 are, for example, milli-volt signals associated with the loadpin outputs in the x- and y-directions, respectively. The outputs of the second summation module 1075 and the third summation module 1080 are multiplied by, for example, a gain factor, an attenuation factor, a scaling factor, etc., in an x-direction scaling module 1085 and a y-direction scaling module 1090, respectively. An output 1095 of the x-direction scaling module 1085 and an output 1100 of the y-direction scaling module 1090 are then provided as an x-output and a y-output to, for example, to the loadpin kinematic model module 560, a shovel control system, payload estimation system, etc.

Figure 12:
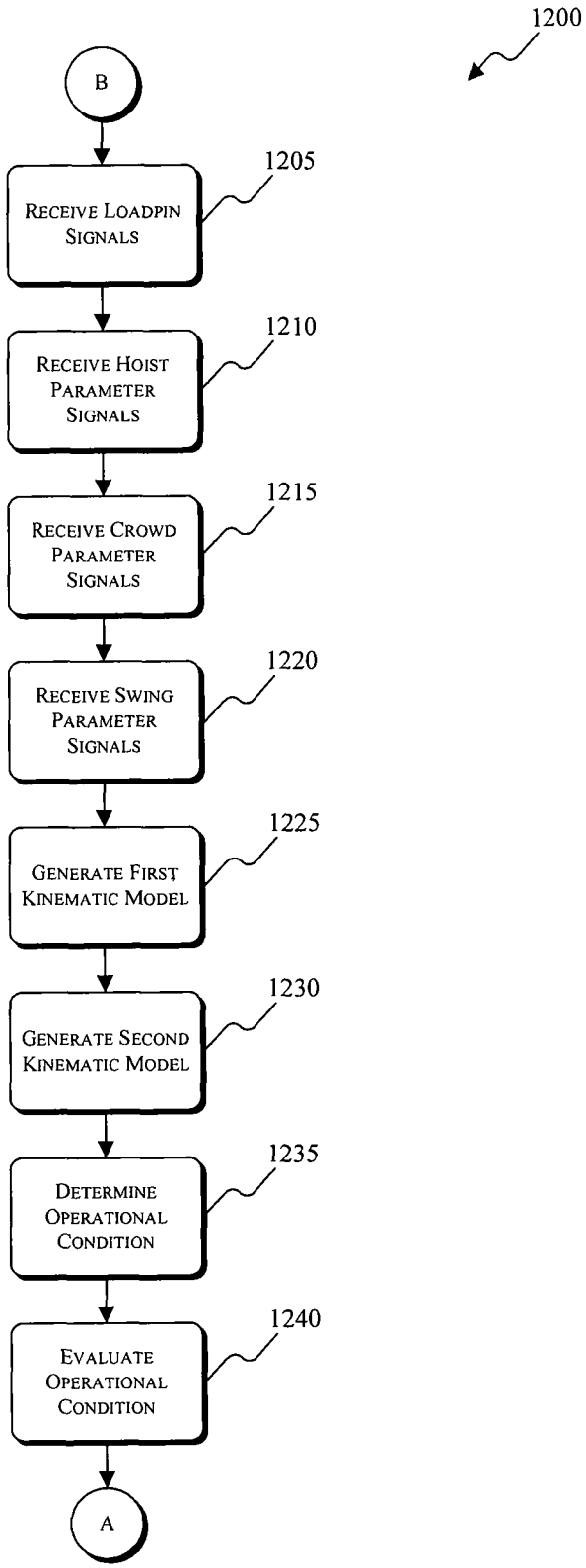
FIGS. 12-13 are a process for actively biasing a loadpin.
Figure 13:
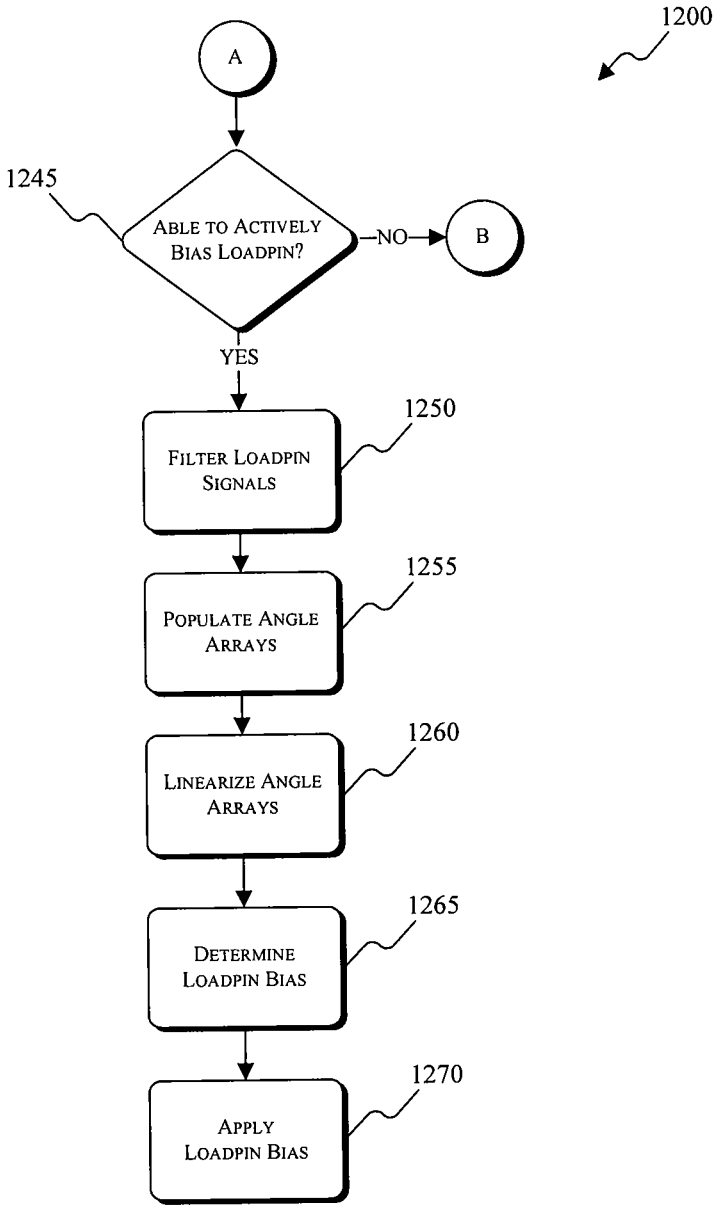

FIGS. 12 and 13 illustrate a process 1200 for actively biasing a loadpin associated with an industrial machine, such as the power shovel 10. The process 1200 is illustrative of a process for actively biasing a loadpin. However, various steps described herein with respect to the process 1200 are capable of being executed simultaneously, in parallel, or in an order that differs from the illustrated serial manner of execution. A plurality of loadpin signals are received (step 1205) from a loadpin that includes a plurality of strain gauges positioned in an x-direction and a y-direction or another suitable geometric relationship (e.g., another orthogonal relationship). A plurality of hoist parameter signals are received (step 1210). A plurality of crowd parameter signals are received (step 1215), and a plurality of swing parameter signals are received (step 1220). A first kinematic model is generated based on the received loadpin signals (step 1225). For example, the first kinematic model is indicative of a force applied to the loadpin in an x-direction and a y-direction, and angle associated with the applied force, etc. A second kinematic model is generated (step 1230) based on the received hoist parameter, crowd parameter, and swing parameter signals. An operational condition of the industrial machine is then determined (step 1235). For example, the operational condition of the industrial machine can be static, dynamic, digging, swinging, etc. However, in order to actively bias the loadpin in a reliable way, the loadpin should not be actively biased during highly-dynamic operations such as digging, swinging, etc. Rather, the loadpin should be actively biased during static or non-dynamic conditions such as raising and lowering the dipper 70, etc. As such, the operational condition of the industrial machine is evaluated (step 1240). With reference to process section A, shown in and described with respect to FIG. 13, the evaluation of the operational condition of the industrial machine is used to determine whether the loadpin can be actively biased (step 1245). If the loadpin cannot be actively biased (i.e., reliably), the process 1200 proceeds to step 1205 of process section B and shown in FIG. 12. If the loadpin can be biased, the loadpin signals are filtered (step 1250) to smooth out dynamic characteristics of the received signals. At step 1255, the angle arrays are populated, and the arrays are then linearized (step 1260). Using the linearized angle arrays, a loadpin bias value or load pin bias values are determined (step 1265), and the loadpin bias value is applied (step 1270) to, for example, the first kinematic model, a payload determination system, etc.

Thus, the invention provides, among other things, systems and methods for actively biasing a loadpin. Various features and advantages of the invention are set forth in the following claims.

What is claimed is:

1. A method of actively biasing a loadpin associated with an industrial machine, the method comprising:

receiving a first plurality of signals from the loadpin related to a force applied to the loadpin, the loadpin having a loadpin bias that corresponds to a deviation in the first plurality of signals that produces an error in the measurement of the force applied to the loadpin, the loadpin bias having a first loadpin bias value;

generating, by a processor, a first characteristic of the industrial machine based on a first kinematic model of the industrial machine, the first kinematic model based on the first plurality of signals from the loadpin;

receiving a second plurality of signals from one or more sensors related to at least one of a hoist parameter, a crowd parameter, and a swing parameter of the industrial machine;

generating, by the processor, a second characteristic of the industrial machine based on a second kinematic model of the industrial machine, the second kinematic model based on the second plurality of signals;

determining, by the processor, an operational condition of the industrial machine;

determining, by the processor, whether the loadpin is able to be actively biased based on the operational condition of the industrial machine;

populating, by the processor, one or more angle arrays based on the first kinematic model of the industrial machine and the second kinematic model of the industrial machine when the loadpin is able to be actively biased;

calculating, by the processor, a second loadpin bias value based on the one or more angle arrays that compensates for the error in the measurement of the force applied to the loadpin; and setting, by the processor, the loadpin bias to the second loadpin bias value.

2. The method of claim 1, wherein the industrial machine is an electric mining shovel.

3. The method of claim 1, further comprising linearizing the one or more angle arrays.

4. The method of claim 1, wherein determining the operational condition of the industrial machine includes determining whether the industrial machine is digging.

5. The method of claim 1, further comprising associating the first characteristic of the industrial machine with the second characteristic of the industrial machine.

6. A system for actively biasing a loadpin associated with an industrial machine, the system comprising:

a memory configured to store one or more parameters associated with the industrial machine;

a processing device connected to the memory, the processing device configured to receive a first plurality of signals from the loadpin related to a force applied to the loadpin, the loadpin having a loadpin bias that corresponds to a deviation in the first plurality of signals that produces an error in the measurement of the force applied to the loadpin, the loadpin bias having a first loadpin bias value;

generate a first characteristic of the industrial machine based on a first kinematic model of the industrial machine, the first kinematic model based on the first plurality of signals from the loadpin;

receive a second plurality of signals from one or more sensors related to at least one of a hoist parameter, a crowd parameter, and a swing parameter of the industrial machine;

generate a second characteristic of the industrial machine based on a second kinematic model of the industrial machine and the one or more parameters, the second kinematic model based on the second plurality of signals;

determine an operational condition of the industrial machine;

determine whether the loadpin is able to be actively biased based on the operational condition of the industrial machine;

populate one or more angle arrays based on the first characteristic of the industrial machine and the second characteristic of the industrial machine when the loadpin is able to be actively biased;

calculate a second loadpin bias value based on the one or more angle arrays that compensates for the error in the measurement of the force applied to the loadpin; and set the loadpin bias to the second loadpin bias value.

7. The system of claim 6, wherein the industrial machine is an electric mining shovel.

8. The system of claim 6, wherein the processing device is further configured to linearize the one or more angle arrays.

9. The system of claim 6, wherein the operational condition of the industrial machine is a digging condition.

10. The system of claim 6, wherein the processing unit is further configured to associate the first characteristic of the industrial machine with the second characteristic of the industrial machine.

11. A method of actively biasing a loadpin associated with an industrial machine, the method comprising:

generating, by a processor, a first characteristic based on a first kinematic model of the industrial machine, the first kinematic model based on a first plurality of signals from the loadpin, the loadpin having a loadpin bias that corresponds to a deviation in the first plurality of signals that produces an error in the measurement of a force applied to the loadpin, the loadpin bias having a first loadpin bias value;

generating, by the processor, a second characteristic based on a second kinematic model of the industrial machine, the second kinematic model based on a second plurality of signals from one or more sensors related to at least one of a hoist parameter, a crowd parameter, and a swing parameter of the industrial machine;

determining, by the processor, whether the loadpin is able to be actively biased based on an operational condition of the industrial machine;

populating, by the processor, two or more angle arrays based on a first kinematic model of the industrial machine and the second kinematic model of the industrial machine when the loadpin is able to be actively biased;

calculating, by the processor, a second loadpin bias value based on the two or more angle arrays that compensates for the error in the measurement of the force applied to the loadpin; and setting the loadpin bias to the second loadpin bias value.

12. The method of claim 11, wherein the industrial machine is an electric mining shovel.

13. The method of claim 11, further comprising linearizing the two or more angle arrays.

14. The method of claim 11, wherein determining the operational condition of the industrial machine includes determining whether the industrial machine is digging.

15. The method of claim 11, further comprising associating the first characteristic with the second characteristic.

16. The method of claim 11, further comprising determining a linearity value for the two or more angle arrays.

17. The method of claim 16, further comprising comparing the linearity value to one or more threshold linearity values.

18. The method of claim 17, further comprising determining whether the loadpin has become unreliable based on the comparison of the linearity value to the one or more linearity values.

* * * * *